US007985100B2

(12) United States Patent
Jaouen et al.

(10) Patent No.: US 7,985,100 B2
(45) Date of Patent: Jul. 26, 2011

(54) COMPUTER NETWORK CONNECTOR

(75) Inventors: Jean-Marc Jaouen, La Sône (FR); Didier Revol, Chatte (FR); Vincent Laroche, Saint-Marcellin (FR); Nathalie Foratier, Saint Antoine l'Abbaye (FR)

(73) Assignees: Legrand France, Limoges (FR); Legrand SNC, Limoges (FR)

( * ) Notice: Subject to any disclaimer, the term of this patent is extended or adjusted under 35 U.S.C. 154(b) by 68 days.

(21) Appl. No.: 12/179,592

(22) Filed: Jul. 25, 2008

(65) Prior Publication Data

US 2009/0029599 A1 Jan. 29, 2009

(30) Foreign Application Priority Data

Jul. 25, 2007 (FR) ..... 07 56733

(51) Int. Cl.
*H01R 24/00* (2011.01)

(52) U.S. Cl. ..... 439/676; 439/941

(58) Field of Classification Search ..... 439/676, 439/941, 862, 404, 405
See application file for complete search history.

(56) References Cited

U.S. PATENT DOCUMENTS

| | | | | |
|---|---|---|---|---|
| 5,249,987 | A | 10/1993 | Kristiansen | |
| 5,547,405 | A * | 8/1996 | Pinney et al. | 439/894 |
| 5,580,270 | A * | 12/1996 | Pantland et al. | 439/395 |
| 5,634,802 | A * | 6/1997 | Kerklaan | 439/131 |
| 5,911,602 | A * | 6/1999 | Vaden | 439/676 |
| 6,045,393 | A | 4/2000 | Alpert | |
| 6,149,458 | A | 11/2000 | Daoud | |
| 6,155,882 | A | 12/2000 | Wu | |
| 6,457,994 | B1 * | 10/2002 | Johnson et al. | 439/492 |
| 6,729,914 | B2 * | 5/2004 | Jaouen | 439/676 |
| 2005/0202697 | A1 * | 9/2005 | Caveney et al. | 439/77 |

FOREIGN PATENT DOCUMENTS

EP 1 482 596 A 12/2004

* cited by examiner

*Primary Examiner* — T C Patel
*Assistant Examiner* — Travis Chambers
(74) *Attorney, Agent, or Firm* — Young & Thompson

(57) ABSTRACT

A connector includes an insert including contacts having free parts to receive homologous flat contacts of a plug. The insert further includes a rotation axis about which the insert can be rotated and spring means urging the insert toward the position that it assumes when no plug is present. The insert can include, at the sides, long curved contacts and, in a central portion, shorter curved contacts, the points of contact of the contacts of the insert with the flat contacts of a plug being substantially aligned over all the contacts.

20 Claims, 7 Drawing Sheets

COMPUTER NETWORK CONNECTOR

BACKGROUND OF THE INVENTION

1. Field of the Invention

The present invention concerns a computer network connector. It applies in particular to RJ45 connectors used for computer networks and covered by the IEC standard 11 801.

2. Description of the Prior Art

RJ45 connectors must be able to accept all RJ45 plugs and sometimes standard RJ11 type plugs without damaging the contacts. Because the tolerances on the dimensions of these plugs are relatively wide, the contacts of the insert of the RJ45 connector must be flexible to accept plugs representing the extremes. However, these contacts must also be sufficiently rigid to provide the necessary contact pressure between the contacts of the insert and the flat contacts of the plugs to obtain a contact of good quality reflected in a low contact resistance.

A number of solutions to this problem are known. A first produces relatively long insert contacts that incorporate crossovers between some contacts to prevent increasing crosstalk problems and to make a start on compensating them. The limitations of this solution are that the compensation achieved between the crossover and the printed circuit (if the insert is pushed onto or soldered to a circuit) is not of optimum efficacy because compensation is effected in air, which entails conforming to standard isolation distances.

A second solution uses shorter contacts to be pushed onto or soldered to a circuit as close as possible to the point of contact to benefit rapidly, in terms of the phase shift of the signal, from the compensation opportunities that the printed circuit provides. In this case, the material used to produce the contacts of the insert is more costly, for example beryllium bronze.

Another solution uses a flexible circuit coming into contact with (or soldered to) the metal contacts of the insert as close as possible to the point of contact and incorporating appropriate compensation means. The drawbacks of this solution are in particular the cost of the flexible circuit and production engineering problems linked to the flexible circuit.

SUMMARY OF THE INVENTION

The present invention aims to overcome these drawbacks.

To this end, the present invention concerns a connector including an insert including contacts having free parts to receive homologous flat contacts of a plug, a rotation axis about which said insert can be rotated and spring means urging the insert toward the position that it assumes when no plug is present.

Thanks to these features, when inserting a plug having the largest dimensions authorized by the standard, the insert rotates and the free parts of the contacts are not permanently deformed. Moreover, despite this flexibility, the contact pressure remains high and guarantees a contact of good quality and, in particular, a low contact resistance.

According to particular features, said insert includes, at the sides, long curved contacts and, in a central portion, shorter curved contacts, the points of contact of the contacts of the insert with the flat contacts of a plug being substantially aligned over all the contacts.

Thanks to these features, the contacts have different stiffnesses and allow the insertion of plugs that do not include flat contacts corresponding to the contacts of the central part, for example RJ11 plugs, and plugs including as many flat contacts as there are contacts in the insert, for example RJ45 plugs. The longer free parts of the lateral contacts allow greater elastic deformation.

According to particular features, the outermost contacts form two pairs and have a crossover for compensating crosstalk.

According to particular features, said insert includes partially overmolded or crimped contacts. Thanks to these features, the relative contact positions are fixed by the overmolding or the crimping, and crosstalk compensation crossovers, capacitances and/or inductances can be formed inside the overmolding or the crimping.

According to particular features, contact crossovers and capacitive lands are provided inside the overmolding to compensate crosstalk generated by the plug.

Thanks to these features, crosstalk is compensated near the points of contact, which improves its efficacy. Moreover, when the insert rotates, the crossovers and capacitive lands are protected from the risk of deformation and therefore of contact with the overmolding or the crimping.

According to particular features, the spring means includes a leaf spring positioned behind the rotation axis relative to the direction of plugging in the plug.

The leaf spring is therefore positioned to the rear of the insert to ensure sufficient contact pressure and to return the insert to its original position on unplugging the plug. This leaf spring can be either an attached metal component or part of a plastic component of the connector, for example. The shape, length, section and material of this leaf spring can be defined without having to comply with constraints imposed by any standards, in contrast to the contacts of the insert.

According to particular features, the insert includes at least one protuberance forming an abutment on which at least one contact comes to bear when plugging in a plug having the maximum dimensions of a standard covering said plug.

For example, for a plug with dimensions greater than those of the mini plug, the contacts come to bear on at least one protuberance of the overmolded part and the insert turns about its rotation axis. This prevents the risk of its contacts being permanently deformed on inserting a maxi plug. In the event of permanent deformation, the contact pressure between the insert and a mini plug could be insufficient to guarantee a contact with the flat contacts of the mini plug of good quality, or could even produce no contact at all.

According to particular features, contacts have a portion to the rear of the rotation axis relative to the direction of plugging in the plug and bearing on lands of a printed circuit.

According to particular features, contacts have a portion to the rear of the rotation axis relative to the direction of plugging in the plug and bearing on metal blades from which are formed insulation-displacement contacts used for connections at the rear of the connector.

According to particular features, contacts have a portion to the rear of the rotation axis relative to the direction of plugging in the plug and in contact with conductive strips linked to insulation-displacement contacts.

Thanks to each of these features, the free movement of these three portions towards the rear when the insert rotates is reflected in sliding of the area of contact and therefore avoids the risk of forces that could lead to breakage or fatigue, such as could appear in the case of soldering instead of bearing interengagement.

BRIEF DESCRIPTION OF THE DRAWINGS

Other advantages, objects and features of the present invention will emerge from the following description, given by way of nonlimiting explanation and with reference to the appended drawings, in which.

DETAILED DESCRIPTION OF PREFERRED EMBODIMENTS

Figure 1A:
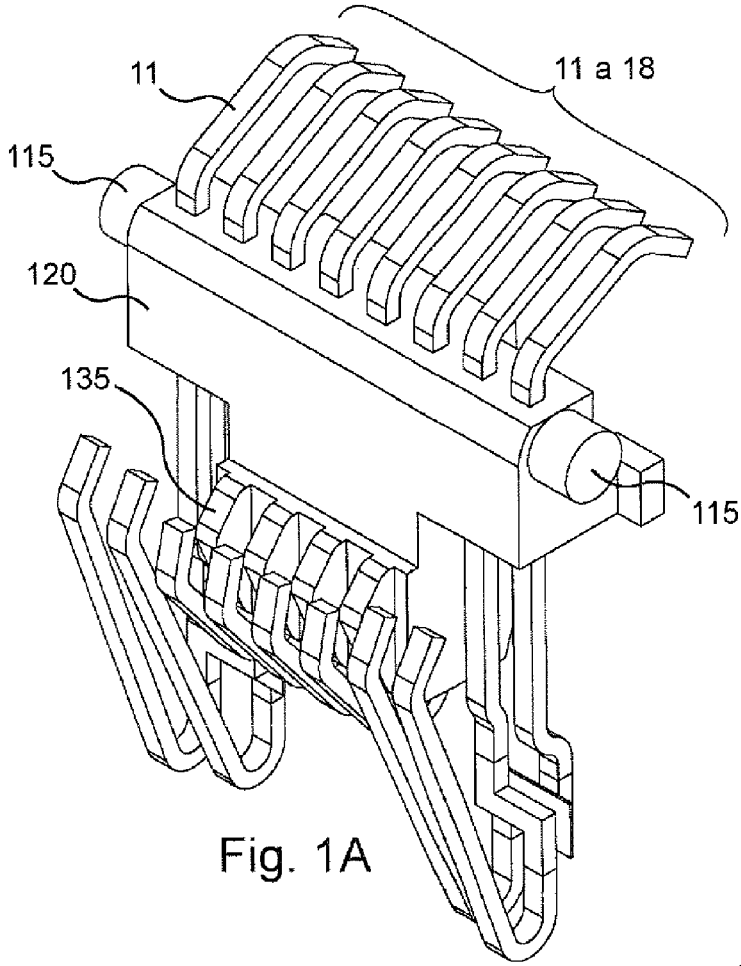
FIG. 1A to 1C represent, in three different directions, one particular embodiment of an insert forming part of a connector of the present invention.
Figure 1B:
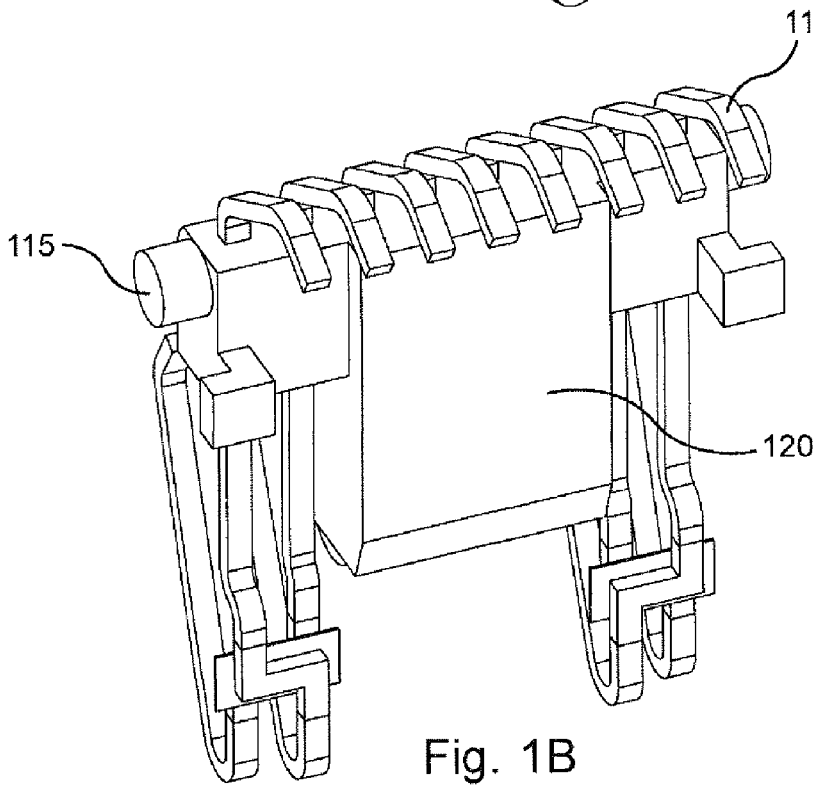
Figure 1C:
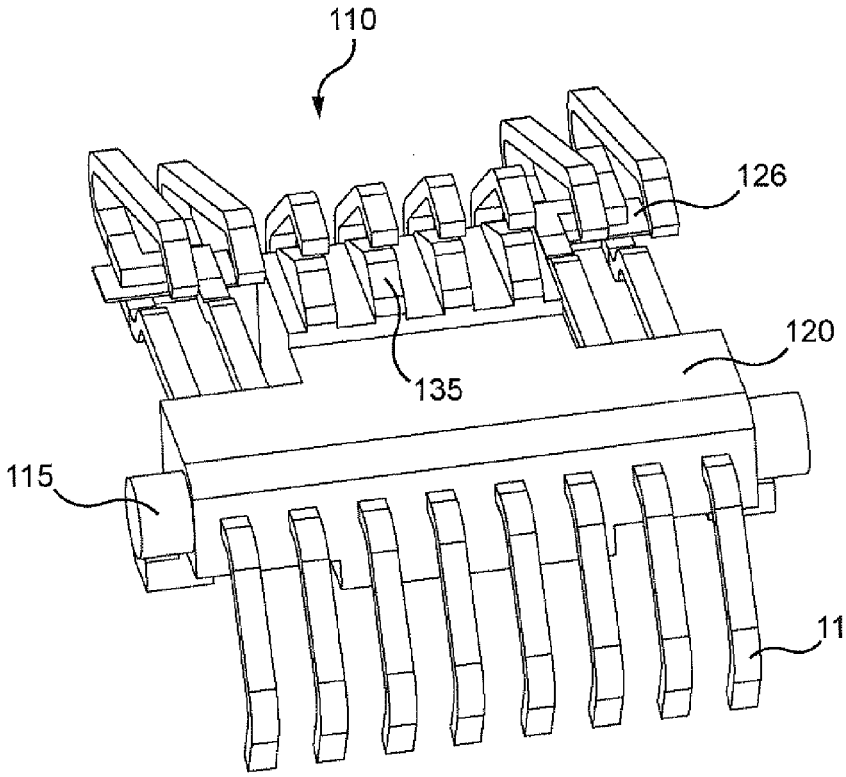
Figure 1D:
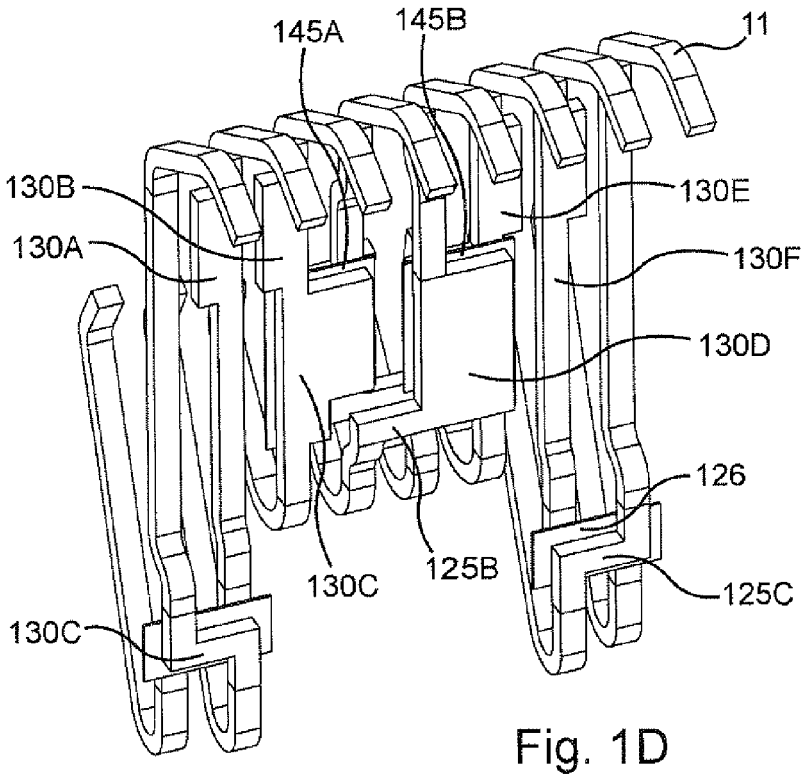
FIG. 1D represents the insert shown in FIGS. 1A to 1C without the overmolding defining the body of the insert.

As explained above, the present invention applies in particular to RJ45 connectors with eight contacts used for computer networks and governed by IEC standard 11 801. The description given hereinafter concerns this type of connector. However, the present invention is not limited to this type of connector and, to the contrary, extends to all connectors having contacts and intended to receive a plug having homologous flat contacts. The RJ45 connectors represented in the figures are intended to receive RJ45 plugs and must be able to accept RJ11 plugs with four contacts defined by the standard without damaging the contacts. The tolerances on the dimensions of these plugs being relatively wide, the contacts of the insert of the connector are sufficiently flexible to accept the extreme plugs and sufficiently rigid to ensure a sufficient contact pressure between the contacts of the insert and the flat contacts of the plugs needed for a contact of good quality that is reflected in a low contact resistance.

The free parts of the contacts of the insert that come into contact with the flat contacts of the plug are substantially coplanar. For the requirements of the description, the contacts of the insert are numbered from 11 to 18 in their order in the rear portion starting from one of the lateral contacts. Thus an RJ11 plug has flat contacts that come to bear on the contacts 13 to 16 whereas an RJ45 plug has flat contacts that come to bear on the contacts 11 to 18.

According to the present invention, and as seen in FIGS. 1A to 2A, 6 and 7, an insert 110 of a connector 105 has a rotation axis 115 substantially parallel to the plane corresponding to the coplanar portions of the free parts of the contacts that receive in bearing interengagement the flat contacts 155A or 155B (see FIG. 4 or 5) of a plug (not shown). This rotation means that shorter contacts can be used than in the prior art in the portion intended to come into contact with the flat contacts of the plug, in order to reduce the distance between that portion and the crosstalk compensation capacitors, whilst being able to receive plugs at the standardized tolerance limits, as explained with reference to FIGS. 4 and 5. The reduction of the length of the front portions of the contacts necessary for compensating crosstalk between signals of very high frequency would not allow sufficient travel of the limit plugs.

The shortest contacts are those that correspond only to RJ45 plugs. The lateral contacts, which correspond to RJ11 plugs, are subjected to higher mechanical stresses because they must be able to deform upon insertion of an RJ45 plug. To the extent that their electrical constraints in terms of crosstalk are more limited, the front portions of these lateral contacts are preferably the same size as in the prior art.

In the embodiment described and shown, the insert 110 includes contacts 11 to 18 over a central portion of which an insert body 120 is molded. Alternatively, a crimping technique (not shown) is used instead of overmolding.

Figure 2A:
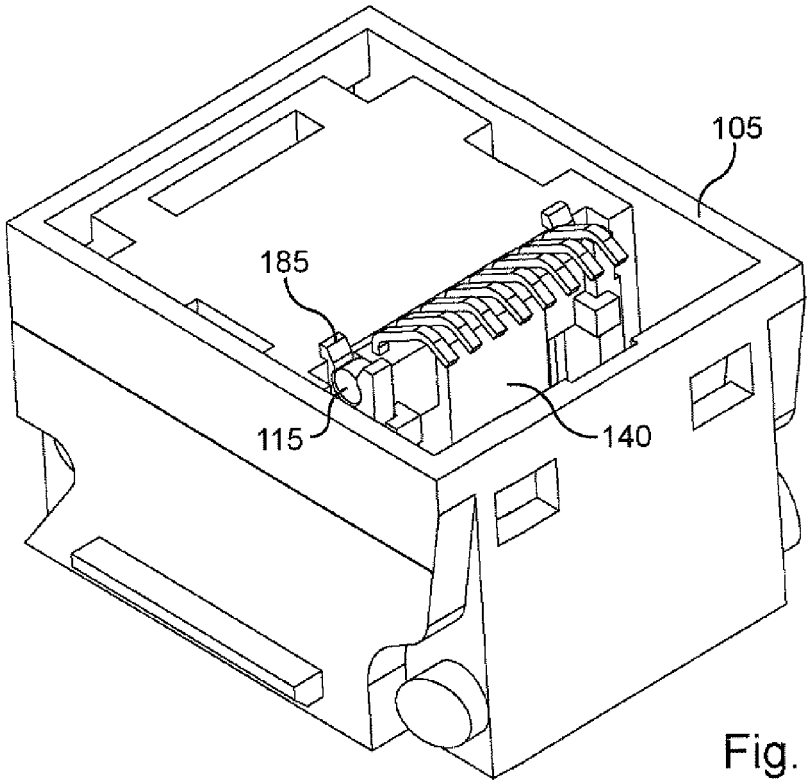
FIGS. 2A and 2B represent, in two different directions, respectively as seen from the rear connection side and from the plug insertion side, one particular embodiment of a connector of the present invention incorporating the insert shown in FIG. 1A to 1D.
Figure 2B:
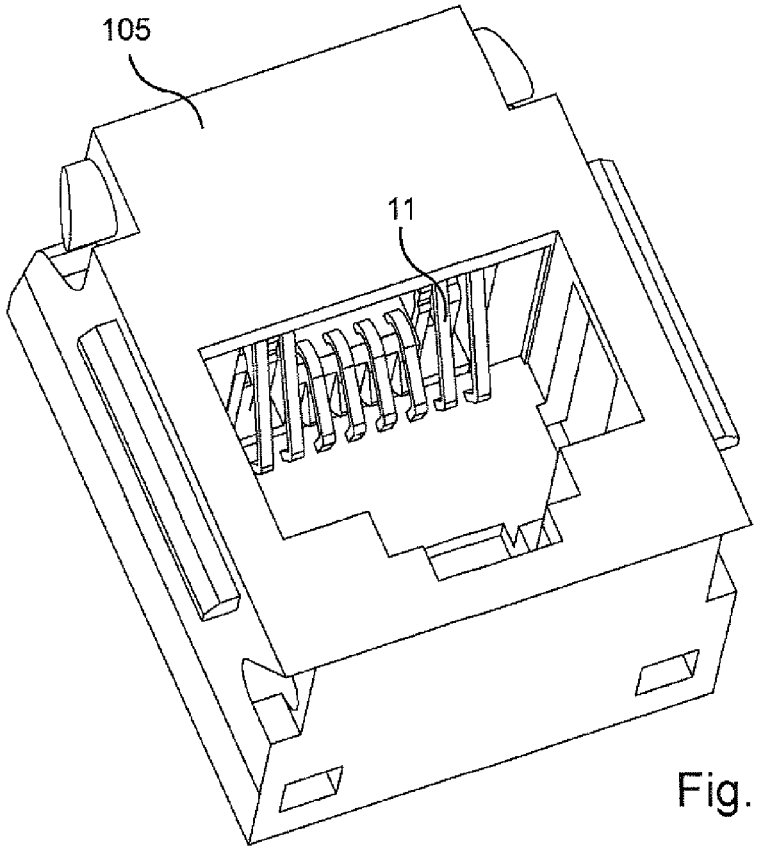
Figure 3:
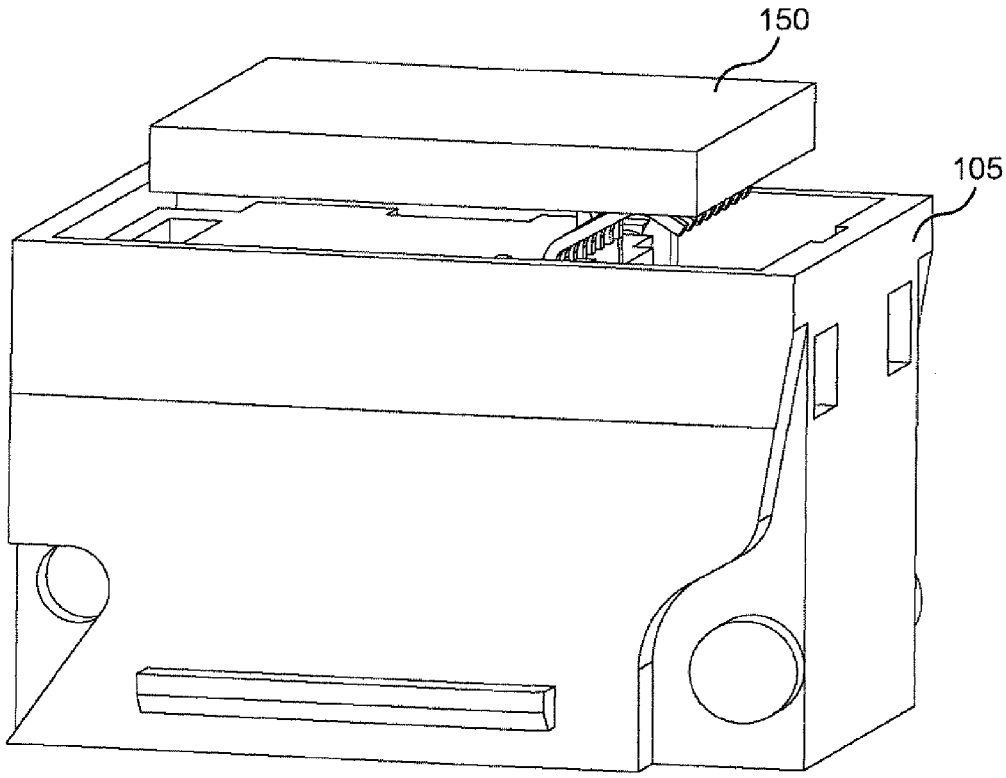
FIG. 3 represents the connector shown in FIGS. 2A and 2B associated with a crosstalk compensation printed circuit.

As can be seen in FIG. 2A, the insert 110 is "clipped" by "clip" means 185 in the connector 105, which is a molded component.

As seen in the figures, the contacts 11 to 18 do not have identical free parts. The contacts 13 to 16 have a shorter free part than the contacts 11, 12, 17 and 18. The most severe crosstalk problems are formed for the signals carried by the contact pairs 13-16 and 14-15, and the free parts of the contacts 13 to 16 being shorter, the signals that they convey are subjected to less phase shift at their entry into the overmolded part 120. At least one crossover 125B and capacitive lands 130A to 130F are provided inside this overmolded part 120 to compensate crosstalk caused by the plug.

Thus the free parts of the contacts 11 to 18, receive in bearing interengagement the flat contacts of the plug corresponding to the contacts 12, 11, 13, 15, 14, 16, 18 and 17, in that order.

The length, section and material of the free part of the contacts 13 to 16 are preferably such that these contacts accept the deformation generated by the introduction of a plug with the minimum dimensions authorized by the standard (referred to hereinafter as a "mini" plug, as compared to a "maxi" plug that corresponds to the maximum dimensions authorized by the standard) and such that these contacts 13 to 16 guarantee a contact pressure of 100 grams per contact.

As shown in FIGS. 2A, 4, 5 and 7, a leaf spring 140 bears on the body 120 of the insert 110 on the side of the body 120 opposite the side in which the areas of contact on the contacts 11 to 18 are situated.

Figure 4:
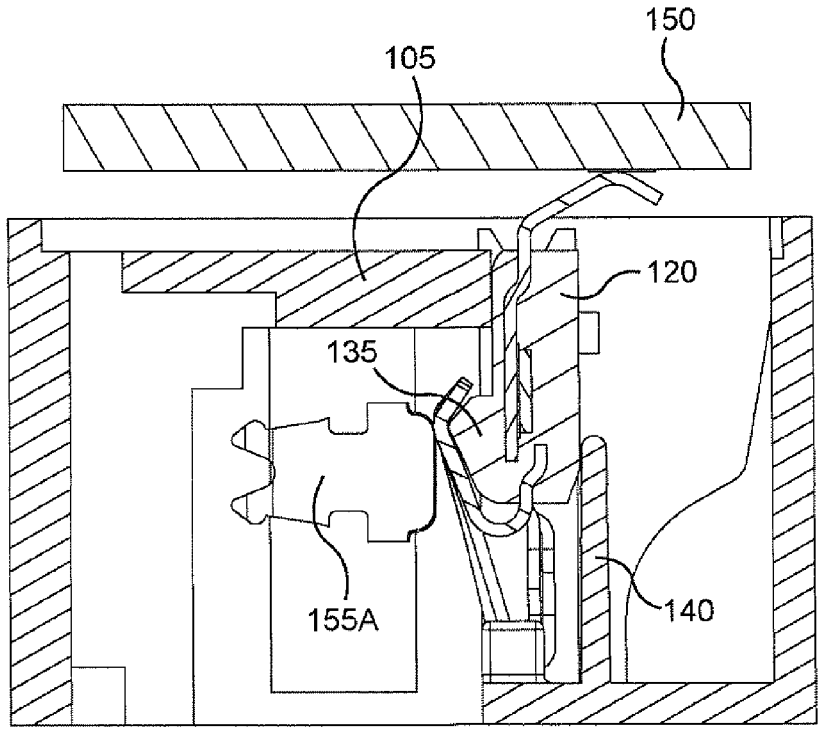
FIG. 4 represents in cross section the connector and the printed circuit from FIG. 3 when a plug with the minimum dimensions is inserted into the connector.

As shown in FIG. 4, for a mini plug, the leaf spring 140, being sufficiently rigid, is not deformed and holds the insert 110 in position to guarantee a good contact pressure between the flat contacts 155A of the plug and the contacts of the insert.

Figure 5:
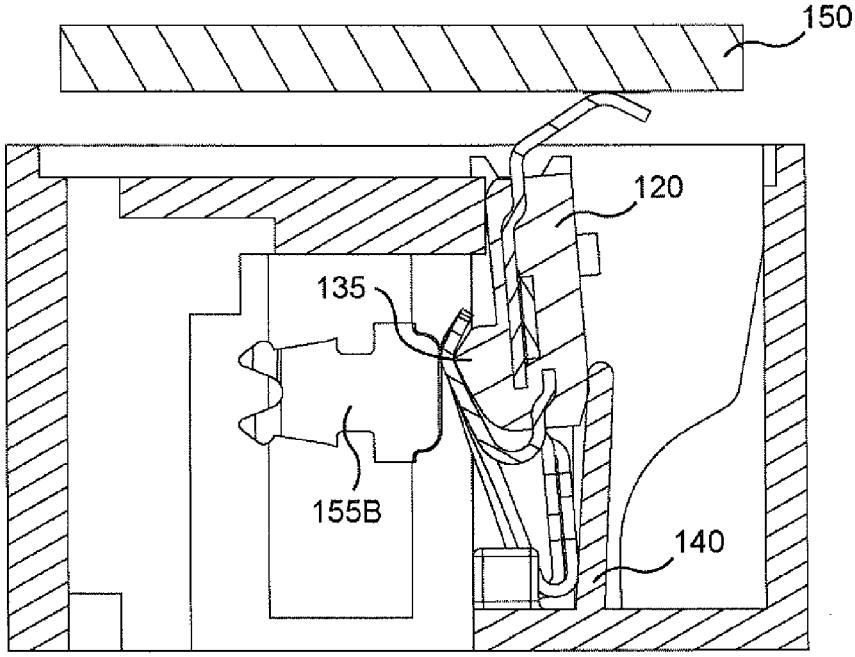
FIG. 5 represents the same view as FIG. 4 when a plug with the maximum dimensions is inserted into the connector.

As shown in FIG. 5, for a plug with dimensions greater than those of the mini plug, the contacts 13 to 16 come to bear on at least one protuberance 135 of the overmolded part 120 provided for this purpose to prevent permanent deformation of the contacts 13 to 16, and the insert 110 turns around its rotation axis 115.

The leaf spring 140 is deformed slightly whilst providing the necessary contact pressure between the flat contacts 155B of the plug and the contacts of the insert. The elasticity of the leaf spring 140 allows the insert 110 to return to its original position on unplugging the plug.

This avoids the risk of permanent deformation of the contacts 13 to 16 on inserting a maxi plug. In the event of permanent deformation, there would be a risk of the contact pressure between the insert 110 and a mini plug being insufficient to guarantee a good quality of contact with the flat contacts 155A of the mini plug, or even providing no contact at all.

Note also that the longer free parts of the contacts 11, 12, 17 and 18 allow greater deformation and the protuberances 135 do not face these contacts, which allows the insertion of an RJ11 plug that causes large but not permanent deformation of these contacts. The crosstalk constraints of the contact pairs 1112 and 17-18 being less severe than those of the contact pairs 11-15 and 14-16, these contacts are longer to be able to withstand the insertion of RJ11 plugs. A crossover 125A, respectively 125C, is provided after the first bend in the contacts 11 and 12, respectively 17 and 18, starting from the area of contact with the flat contacts of the plug, to commence crosstalk compensation as soon as possible. In the embodiment described and shown, the crossovers 125A and 125C are outside the overmolding 120. To avoid accidental contact, each crossover has a separation film 126, for example a film of adhesive polyamide. A capacitive land 130A is formed by enlarging the contact 12 toward the contact 11 inside the overmolding 120. A capacitive land 130F is formed by enlarging the contact 17 toward the contact 18 inside the overmolding 120.

Inside the body of the insert, i.e. the overmolding 120, a crossover 125B is provided between the contacts 14 and 15. A capacitive land 130C is formed by facing planes formed in the contacts 13 and 15. A capacitive land 130D is formed by facing planes formed in the contacts 14 and 16. These planes are separated by a film 145A, respectively 145B, for example a film of adhesive polyamide.

Note that the capacitive lands 130C and 130D are as close as possible to the front parts of the contacts 13 to 16. Because of this, and because the front parts of the contacts 13 to 16 are shortened, crosstalk compensation is effected very close to the area of contact of the homologous flat contacts of the plug. This compensation is therefore effected with a very limited phase shift and therefore extends up to very high frequencies of the signals conveyed.

Note also that the films 145A and 145B project at the sides farther from the respective capacitive lands 130C and 130D than the film 126 of the crossover area of the contacts because breakdown problems are greater in air than inside the overmolding.

A capacitive land 130B is formed by enlarging the contact 13 toward the contact 12 inside the overmolding 120. A capacitive land 130E is formed by enlarging the contact 16 toward the contact 17 inside the overmolding 120.

In the embodiment shown in FIGS. 1A to 5, the leaf spring 140 positioned to the rear of the insert 110 is molded in one piece with the connector 105 to provide sufficient contact pressure and to return the insert to its original position on unplugging the plug. Note that the shape, length, section and material of this leaf spring 140 can be defined without having to comply with the constraints of any standards, in contrast to the contacts of the insert 110.

To enable rotation of the insert 110, the ends of the contacts outside the overmolding (on the rear side relative to the direction of plugging in the plug) are not inserted into a printed circuit 150 but press on SMC (Surface Mount Component) lands or patches of the printed circuit 150 (see FIGS. 3 to 5), which provide electrical continuity.

Note that, because of the rotation of the insert when inserting a plug larger than a mini plug, the rear parts of the contacts press harder on a printed circuit 150 without exceeding their elastic limit, which avoids permanent deformation thereof.

Figure 6:
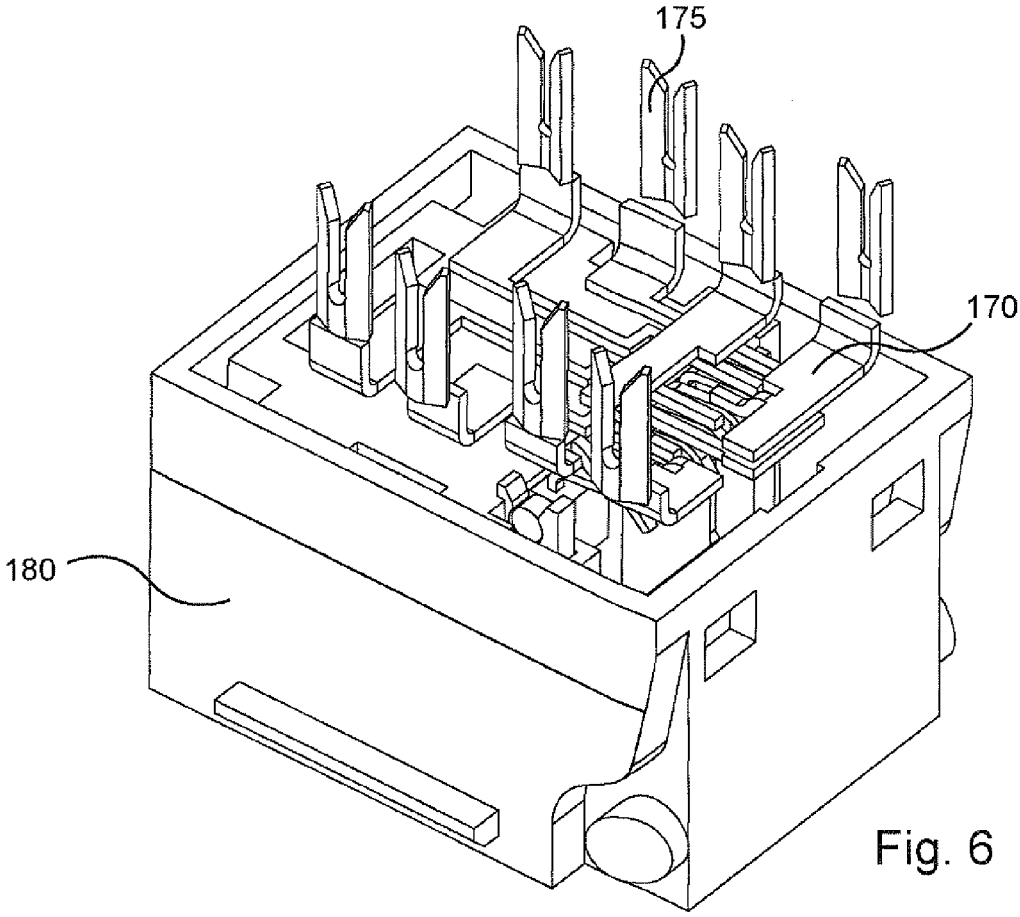
FIGS. 6 to 8 represent an associated insulation displacement contact terminal block in a second embodiment of a connector of the present invention.
Figure 7:
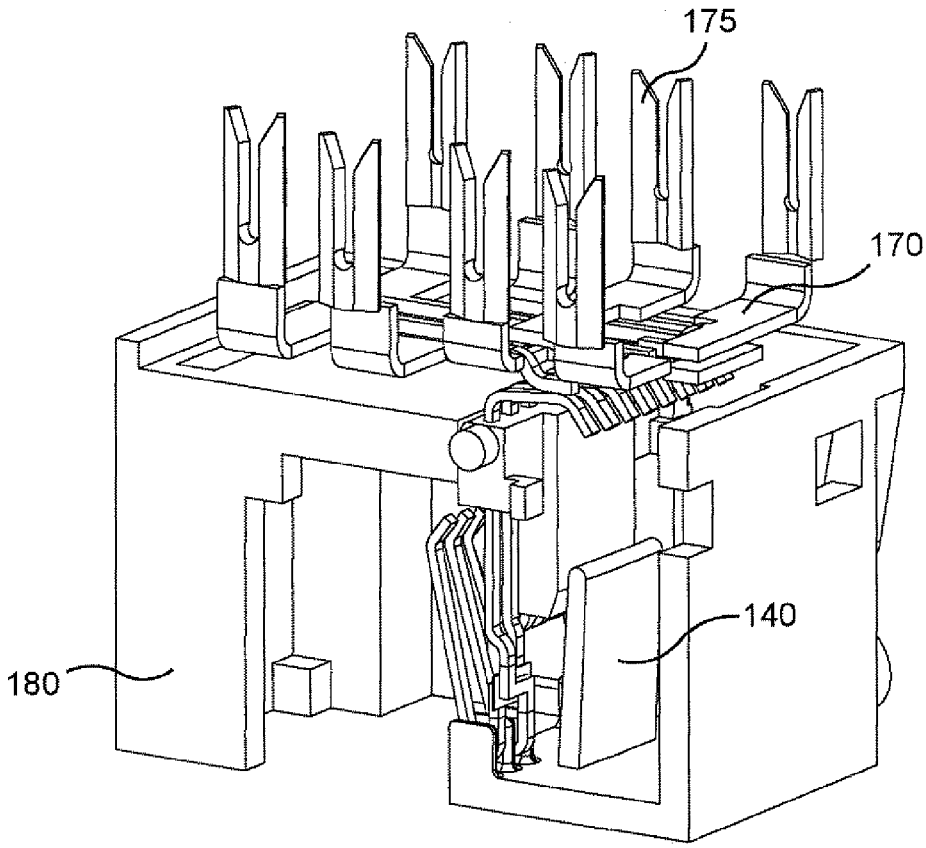
Figure 8:
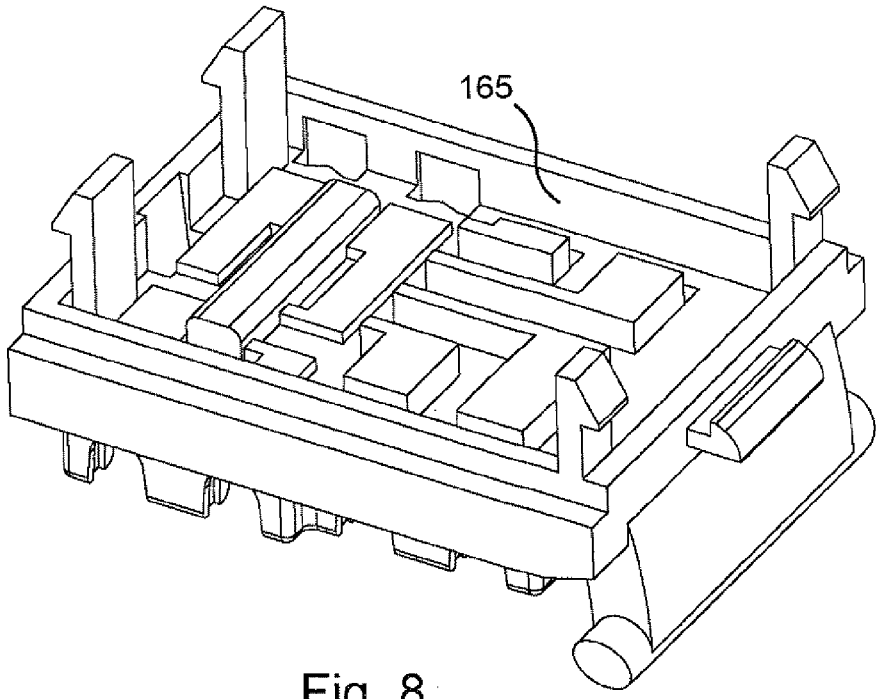

In a second embodiment, shown in FIGS. 6 to 8, these rear free ends press directly on metal blades from which are formed insulation-displacement contacts (IDC) used for the connections at the rear of the RJ45 connector.

Alternatively, and in particular if the performance to be achieved does not require the use of a printed circuit to compensate crosstalk, for connectors of category 5, for example, the insert 110 comes directly into contact with strips 170 from which are formed the insulation-displacement contacts 175, as shown in FIGS. 6 to 8. The insulation-displacement contacts can be produced from two cut and bent strips.

FIG. 6 shows that the insulation-displacement contacts 175 are formed from two cut and bent strips 170. Note, in FIG. 7, that the areas of contact are pressed between the rear parts of the contacts of the insert 110 and the strips 170 of the insulation-displacement contacts 175. Note, in FIG. 8, that the strips of insulation-displacement contacts 170 are mounted in and held in position in a plastic terminal block 165. Note also that an abutment (not shown) is positioned under the contact area.

Figure 9:
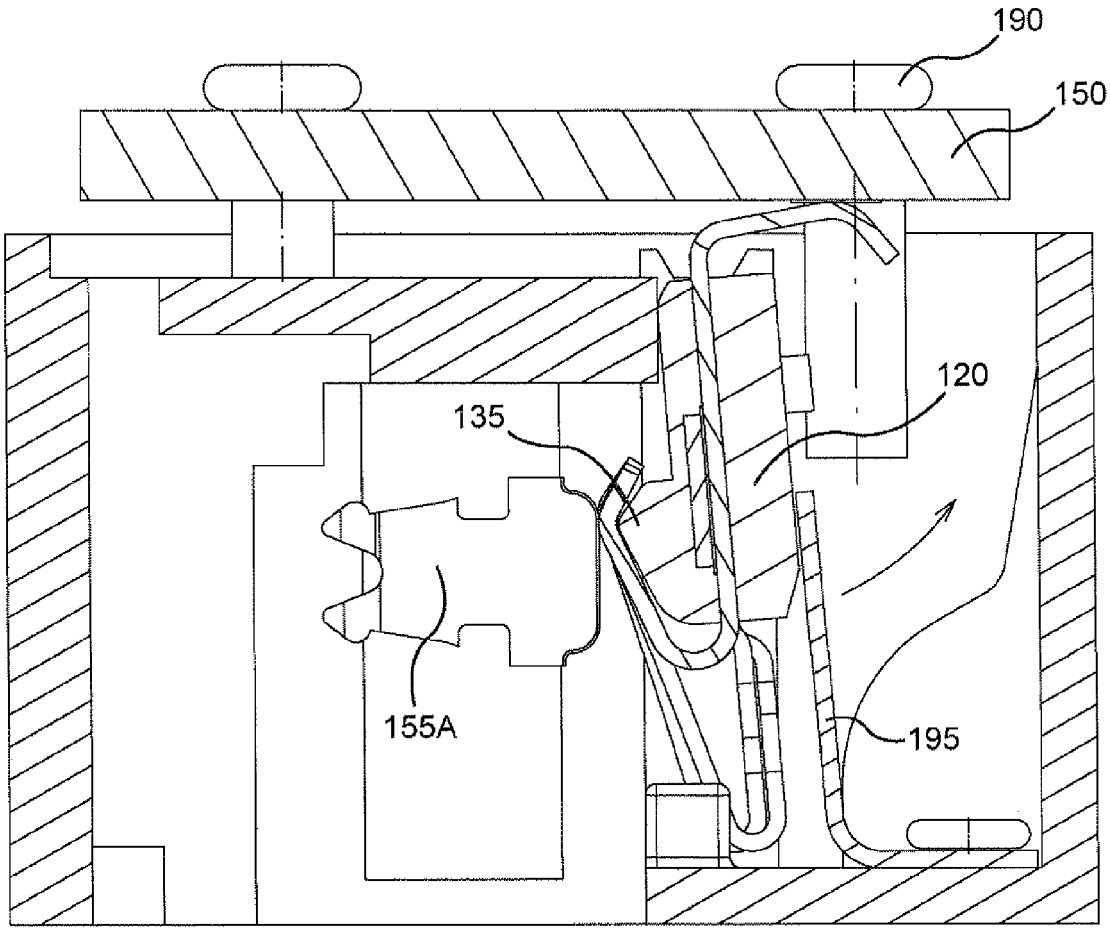
FIG. 9 represents in cross section a variant of the connector shown in FIGS. 4 and 5.

As can be seen in FIG. 9, in the second embodiment, the spring effect necessary for returning the insert to its original position is produced by the metal blade 195 mounted in the connector 180 and not by the molded connector as in the first embodiment. Thus the leaf spring 140 molded into the connector 105 of the first embodiment is replaced by a leaf spring 195 crimped into the connector 105. This second embodiment can in particular be useful in the case of a shielded product where the connector would be of zamac and would not allow the necessary flexibility to be obtained.

FIG. 9 also shows the crimping of the circuit 150 to the connector 105 by means of crimped lugs 190. This crimping circumvents stacking of the tolerances of all the parts and therefore reduces the relative movement of the contacts pressing on the circuit 150 between "mini clearance" and "maxi clearance" positions.

The invention claimed is:

1. A connector, comprising:

an insert including an insert body and a plurality of contacts extending through the insert body, a first portion of said contacts extending from a first side of the insert body and a second portion of said contacts extending from a second side of the insert body, the first portion of said contacts having free parts to receive homologous flat contacts of a plug, the insert body of said insert further including at least one rotation member about which said insert can be rotated;

a connector housing, the rotation member pivotably mounted to the connector housing; and spring means connected to said connector housing and disposed against the insert, said spring means configured to be at rest when no plug is present, and said spring means configured to be in tension when a plug is present to urge the insert to rotate and press the free parts of the first portion of said contacts against the homologous flat contacts of the plug.

2. The connector claimed in claim 1, wherein an outermost of the contacts form two pairs and have a crossover for compensating crosstalk.

3. The connector claimed in claim 1, wherein the spring means includes a leaf spring positioned at a distance from the rotation member in a direction extending from the rotation member and opposite a direction wherein the plug is to be plugged in.

4. The connector claimed in claim 1, wherein the insert includes at least one protuberance forming an abutment on which at least one contact comes to bear when plugging in a plug having the maximum dimensions of a standard covering said plug.

5. The connector claimed in claim 1, wherein the free parts of the contacts have portions configured to bear on lands of a printed circuit.

6. The connector claimed in claim 1, wherein the free parts of the contacts have portions configured to bear on metal blades forming insulation-displacement contacts used for connections at the rear of the connector.

7. The connector claimed in claim 1, wherein the free parts of the contacts have portions in contact with conductive strips linked to insulation-displacement contacts.

8. The connector claimed in claim 1, wherein said free parts include long curved contacts on opposite sides flanking shorter curved contacts in between the long curved contacts, points of contact of the c free parts configured to substantially align with the flat contacts of the plug.

9. The connector claimed in claim 8, wherein outermost free parts form two pairs and have a crossover for compensating crosstalk.

10. The connector claimed in claim 1, wherein said insert includes partially overmolded contacts inside an overmolded part.

11. The connector claimed in claim 10, wherein contact crossovers and capacitive lands are provided inside the overmolded part to compensate crosstalk generated by the plug.

12. The connector claimed in claim 11, wherein said free parts include long curved contacts on opposite sides flanking shorter curved contacts in between the long curved contacts, points of contact of the c free parts configured to substantially align with the flat contacts of the plug.

13. The connector claimed in claim 12, wherein the contacts crossing over constitute two central contacts, and the capacitive lands are provided, after crossover, with contacts immediately surrounding the central contacts.

14. The connector claimed in claim 11, wherein the contacts crossing over constitute two central contacts, and the capacitive lands are provided, after crossover, with contacts immediately surrounding the central contacts.

15. The connector claimed in claim 14, wherein outermost free parts form two pairs and have a crossover for compensating crosstalk.

16. The connector claimed in claim 15, wherein the contacts crossing over constitute two central contacts, and the capacitive lands are provided, after crossover, with contacts immediately surrounding the central contacts.

17. The connector claimed in claim 11, wherein outermost free parts form two pairs and have a crossover for compensating crosstalk.

18. The connector claimed in claim 17, wherein the contacts crossing over constitute two central contacts, and the capacitive lands are provided, after crossover, with contacts immediately surrounding the central contacts.

19. A connector, comprising:

a connector housing, having an opening for receiving a plug;

an insert body rotatably connected to said connector housing to rotate relative to the connector housing about a rotation axis extending through first and second ends of said insert body;

a plurality of elongated contacts having first and opposite second free ends, the elongated contacts extending through a first side of the insert body and out a second side of the insert body so that the first free ends extend from the first side and the second free ends extend from the second side; and spring means connected to said connector housing configured to, when the plug is received in the opening, exert a force in tension against the insert body and urge the first free ends extending from the first side of the insert body about the rotation axis to bear against homologous flat contacts of the plug when the plug is received in the opening, the spring means further configured to be at rest when the plug is not present in the opening.

20. The connector claimed in claim 19, wherein the second free ends are configured to bear against connectors for connecting to the homologous flat contacts of the plug via the first free ends, wherein the insert body further includes first and second axially extended portions extending opposite each other along the rotation axis from the first and second ends of the insert body, the extended portions rotatably connected to the connector housing, and wherein the insert body yet further includes at least one protuberance forming an abutment aligned with at least one of the first free ends extending from the first side of the insert body, the at least one of the first free ends configured to rest at a distance from the at least one protuberance in a first mode, and to bear against the at least one protuberance in a second mode in which the plug is received in the opening.

* * * * *